US011564497B2

(12) United States Patent
Sha et al.

(10) Patent No.: US 11,564,497 B2
(45) Date of Patent: Jan. 31, 2023

(54) STRETCHING DEVICE FOR LEISURE CHAIR

(71) Applicant: Jianbo Sha, Taizhou (CN)

(72) Inventors: Jianbo Sha, Taizhou (CN); Guoli Zou, Taizhou (CN); Wei Lu, Taizhou (CN)

(73) Assignee: Jianbo Sha, Taizhou (CN)

( * ) Notice: Subject to any disclaimer, the term of this patent is extended or adjusted under 35 U.S.C. 154(b) by 0 days.

(21) Appl. No.: 17/389,377

(22) Filed: Jul. 30, 2021

(65) Prior Publication Data

US 2023/0000251 A1 Jan. 5, 2023

(30) Foreign Application Priority Data

Jul. 5, 2021 (CN) ..... 202121508585.X

(51) Int. Cl.

| | |
|---|---|
| ***A47C 1/035*** | (2006.01) |
| ***A47C 1/034*** | (2006.01) |
| ***A47C 7/40*** | (2006.01) |
| ***A47C 7/50*** | (2006.01) |
| ***A47C 1/032*** | (2006.01) |

(52) U.S. Cl.

CPC ..... *A47C 1/0345* (2013.01); *A47C 1/035* (2013.01); *A47C 1/03211* (2013.01); *A47C 7/40* (2013.01); *A47C 7/5068* (2018.08)

(58) Field of Classification Search

CPC ..... A47C 1/035
USPC ..... 297/85 M
See application file for complete search history.

(56) References Cited

U.S. PATENT DOCUMENTS

| | | | | |
|---|---|---|---|---|
| 3,934,929 | A * | 1/1976 | Rabinowitz | A61G 15/02 297/90 X |
| 5,466,046 | A * | 11/1995 | Komorowski | A61G 5/14 297/85 M X |
| 5,651,580 | A * | 7/1997 | LaPointe | A61G 5/14 297/85 M X |
| 5,730,494 | A * | 3/1998 | LaPointe | A61G 5/14 297/85 M X |
| 6,557,934 | B2 * | 5/2003 | Wiecek | A47C 1/0352 297/84 |
| 7,997,644 | B2 * | 8/2011 | Hoffman | A47C 3/0255 297/85 M X |
| 8,308,228 | B2 * | 11/2012 | Lawson | A47C 1/029 297/85 R X |

(Continued)

*Primary Examiner* — Rodney B White
(74) *Attorney, Agent, or Firm* — Bayramoglu Law Offices LLC

(57) ABSTRACT

A stretching device for a leisure chair includes a base. Stretching assemblies are symmetrically and pivotally connected to two sides of the base. The stretching assembly includes a seat plate mechanism. The front part of the seat plate mechanism is pivotally connected to a leg mechanism. The rear part of the seat plate mechanism is pivotally connected to a backrest mechanism. A drive mechanism is provided between the stretching assemblies. The drive mechanism includes a front drive rod and a rear drive rod. The front drive rod and the rear drive rod drive the stretching assemblies to unfold or fold by a reciprocating motion device. Two ends of the front drive rod are fixedly connected to the leg mechanism. Two ends of the rear drive rod are pivotally connected to a first drive member. The middle part of the first drive member is pivotally connected to a second drive member.

5 Claims, 5 Drawing Sheets

(56) References Cited

U.S. PATENT DOCUMENTS

| | | | | |
|---|---|---|---|---|
| 8,419,122 | B2 * | 4/2013 | Lawson | A47C 1/035 297/85 M X |
| 8,506,009 | B2 * | 8/2013 | LaPointe | A47C 1/0355 297/85 M |
| 8,833,844 | B2 * | 9/2014 | LaPointe | A47C 1/0355 297/85 M X |
| 9,010,851 | B2 * | 4/2015 | LaPointe | A47C 1/03205 297/85 M |
| 9,039,078 | B2 * | 5/2015 | Lawson | A61G 5/14 297/85 R X |
| 9,358,167 | B2 * | 6/2016 | LaPointe | A47C 1/029 |
| 10,383,443 | B2 * | 8/2019 | Lawson | A47C 1/032 |
| 10,390,621 | B2 * | 8/2019 | Lawson | A47C 1/124 |
| 10,485,347 | B2 * | 11/2019 | Lawson | A47C 1/0355 |
| 10,485,719 | B2 * | 11/2019 | Murphy | A47C 1/0242 |
| 10,524,574 | B2 * | 1/2020 | LaPointe | A47C 1/034 |
| 10,682,271 | B2 * | 6/2020 | Lin | A47C 7/5068 |
| 10,779,653 | B2 * | 9/2020 | LaPointe | A47C 3/027 |
| 10,820,708 | B2 * | 11/2020 | LaPointe | A47C 7/506 |
| 11,197,549 | B1 * | 12/2021 | LaPointe | A47C 1/0352 |
| 11,266,245 | B2 * | 3/2022 | Lawson | A47C 1/03211 |
| 2008/0150329 | A1 * | 6/2008 | Lawson | A47C 1/0355 297/84 |

* cited by examiner

STRETCHING DEVICE FOR LEISURE CHAIR

CROSS REFERENCE TO THE RELATED APPLICATIONS

This application is based upon and claims priority to Chinese Patent Application No. 202121508585.X, filed on Jul. 5, 2021, the entire contents of which are incorporated herein by reference.

TECHNICAL FIELD

The present invention relates to the field of furniture manufacturing, and in particular to a stretching device for a leisure chair.

BACKGROUND

At present, many rocking chairs, recliners, sofas, and the like are equipped with an electromechanical stretching device, on which a backrest, a seat cushion and a leg rest are mounted. The electromechanical stretching device is typically a combination of various mechanical connectors, which realizes the switching between a sitting posture mode, a television (TV)-watching posture mode and a lying posture mode through a drive mechanism. However, the connections between the drive mechanism and the mechanical stretching assemblies lack guidance, as a result, the motions of the mechanical stretching assemblies on both sides are generally not synchronized, which affects user experience.

SUMMARY

To overcome the shortcomings of the prior art, an objective of the present invention is to provide a stretching device for a leisure chair to avoid the problem that the motions of the mechanical stretching assemblies on both sides are not synchronized, thereby improving user experience.

To achieve the above objective, the present invention adopts the following technical solution.

A stretching device for a leisure chair includes a base. Stretching assemblies are symmetrically and pivotally connected to two sides of the base. The stretching assembly includes a seat plate mechanism. The front part of the seat plate mechanism is pivotally connected to a leg mechanism, and the rear part of the seat plate mechanism is pivotally connected to a backrest mechanism. A drive mechanism is provided between the stretching assemblies. The drive mechanism includes a front drive rod and a rear drive rod. The front drive rod and the rear drive rod drive the stretching assemblies to unfold or fold by a reciprocating motion device. The two ends of the front drive rod are fixedly connected to the leg mechanism. The two ends of the rear drive rod are pivotally connected to a first drive member. The middle part of the first drive member is pivotally connected to a second drive member. The other end of the first drive member and the other end of the second drive member are pivotally connected to the seat plate mechanism. The first drive member is fixedly connected to a first limit pin. The rear drive rod is provided with an arcuate-slotted hole through which the first limit pin slides.

Preferably, the base includes a base frame. Mounting frames are fixedly connected to two sides of the base frame, and the mounting frames are configured to pivotally connect the seat plate mechanism.

Preferably, the seat plate mechanism includes a first front rotating member and a first rear rotating member. The first front rotating member is pivotally connected to the front part of the mounting frame, and the first rear rotating member is pivotally connected to the rear part of the mounting frame. The other end of the first front rotating member and the other end of the first rear rotating member are pivotally connected to a first side link rod. The front part of the first side link rod is pivotally connected to a second front rotating member. The middle inner side of the second front rotating member is pivotally connected to the first drive member, and the middle outer side of the second front rotating member is pivotally connected to a side assembly plate. The middle part of the first side link rod is pivotally connected to the second drive member. The rear part of the first side link rod is pivotally connected to the second rear rotating member. The other end of the second rear rotating member is pivotally connected to a second side link rod. The leg mechanism includes a footrest. The footrest is pivotally connected to a first leg link rod and a second leg link rod. The other end of the first leg link rod is pivotally connected to a third leg link rod, and the other end of the second leg link rod is pivotally connected to a fourth leg link rod. The other end of the third leg link rod and the other end of the fourth leg link rod are pivotally connected to the front part of the side assembly plate. The rear part of the second leg link rod is pivotally connected to the front part of the second leg link rod. The rear part of the fourth leg link rod is pivotally connected to the front end of the second side link rod. The backrest mechanism includes a backrest mounting plate. The front end of the backrest mounting plate is pivotally connected to the second front rotating member. The middle front part of the backrest mounting plate is pivotally connected to the side assembly plate, and the middle part of the backrest mounting plate is pivotally connected to a backrest rotating member. The backrest rotating member is pivotally connected to a backrest drive member. The other end of the backrest drive member is pivotally connected to the rear end of the first side link rod. One end of the backrest rotating member is pivotally connected to the rear end of the second side link rod.

Preferably, a tension spring is provided between the second front rotating member and the rear drive rod.

Preferably, the reciprocating motion device includes a motor hinged to the front drive rod. The motor drives a sliding block to slide on a sliding rail, and the sliding block is fixedly connected to the rear drive rod.

Compared with the prior art, the present invention has the following advantages.

1. When the reciprocating motion device is activated, the front drive rod and the rear drive rod drive the stretching assemblies to unfold or fold. Meanwhile, the first limit pin slides in the arcuate-slotted hole to guide the rotation of the first drive member and the second drive member. In this way, it is ensured that the motions of the mechanical stretching assemblies on both sides are synchronized, thereby improving user experience.

2. A tension spring is provided, which plays a role in resetting and guiding when the stretching assembly is fully unfolded and then folded, thereby ensuring that the backrest mechanism is reset first.

Figure 1:
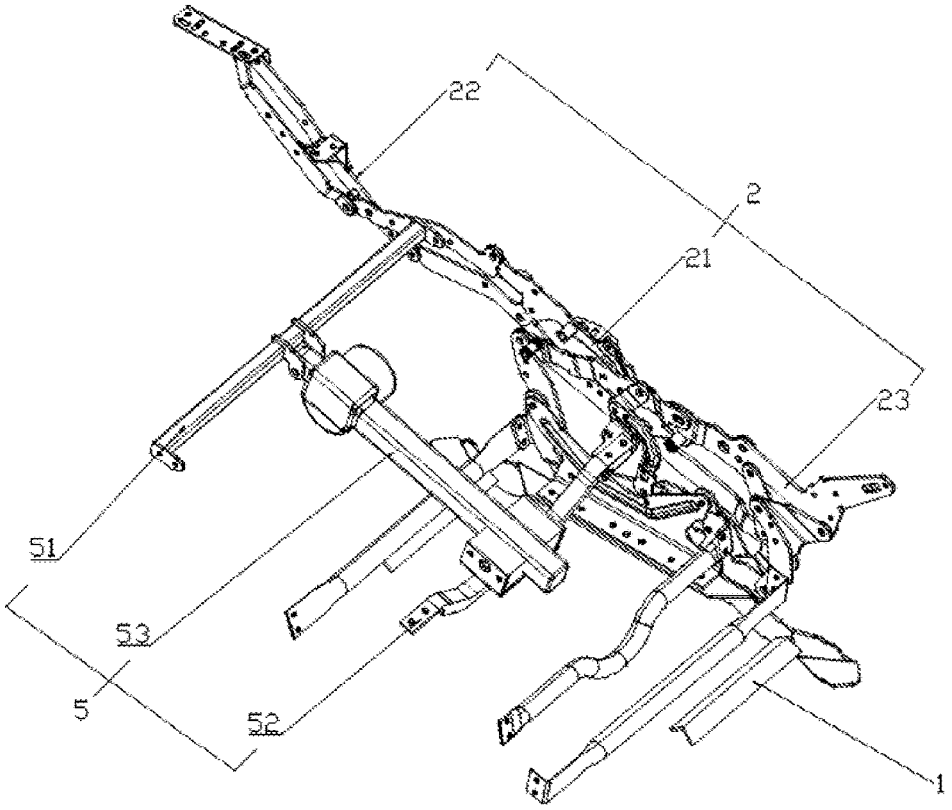
FIG. 1 is a schematic structural diagram of a stretching device for a leisure chair according to the present invention.

Reference numerals: 1. base; 11. base frame; 12. mounting frame; 2. stretching assembly; 21. seat plate mechanism; 211. first front rotating member; 212. first rear rotating member; 213. first side link rod; 214. second front rotating member; 2141. hanging pin; 2142. first limit surface; 2143. second limit surface; 215. side assembly plate; 216. spacer; 217. seat plate limit member; 2171. limit groove; 218. second rear rotating member; 219. second side link rod; 22. leg mechanism; 221. footrest; 222. first leg link rod; 223. third leg link rod; 2231. third limit surface; 2232. fourth limit surface; 224. second leg link rod; 225. fourth leg link rod; 23. backrest mechanism; 231. backrest mounting plate; 232. backrest rotating member; 233. backrest drive member; 234. backrest limit member; 2341. slotted limit groove; 301. first shaft; 302. second shaft; 303. third shaft; 304. fourth shaft; 305. fifth shaft; 306. sixth shaft; 307. seventh shaft; 308. eighth shaft; 309. ninth shaft; 310. tenth shaft; 311. eleventh shaft; 312. twelfth shaft; 313. thirteenth shaft; 314. fourteenth shaft; 315. fifteenth shaft; 316. sixteenth shaft; 317. seventeenth shaft; 318. eighteenth shaft; 319. nineteenth shaft; 320. twentieth shaft; 321. twenty-first shaft; 322. twenty-second shaft; 323. twenty-third shaft; 324. twenty-fourth shaft; 325. twenty-fifth shaft; 326. twenty-sixth shaft; 327. twenty-seventh shaft; 401. first limit pin; 402. second limit pin; 403. third limit pin; 404. fourth limit pin; 405. fifth limit pin; 406. sixth limit pin; 5. drive mechanism; 51. front drive rod; 52. rear drive rod; 521. rear drive rod body; 522. bending member; 5221. arcuate-slotted hole; 523. first drive member; 524. second drive member; 53. reciprocating motion device; 531. motor; 532. sliding block; 533. sliding rail; and 6. tension spring.

DETAILED DESCRIPTION OF THE EMBODIMENTS

The present invention is further described below with reference to the drawing and specific implementations. It should be understood that these implementations are only intended to illustrate the present invention, rather than to limit the scope of the present invention. Modifications made to the equivalent or similar structures of the present invention by those skilled in the art after reading the present invention should fall within the scope defined by the appended claims of the present invention.

Figure 2:
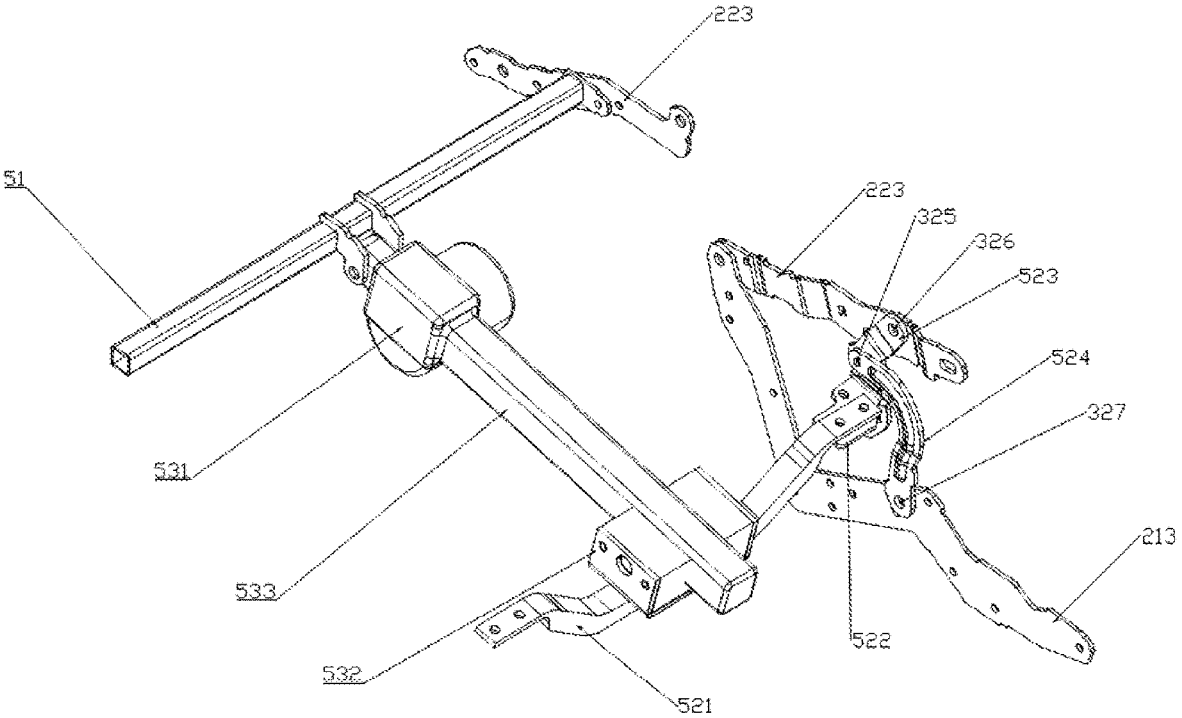
FIG. 2 is a schematic structural diagram of a drive mechanism.
Figure 3:
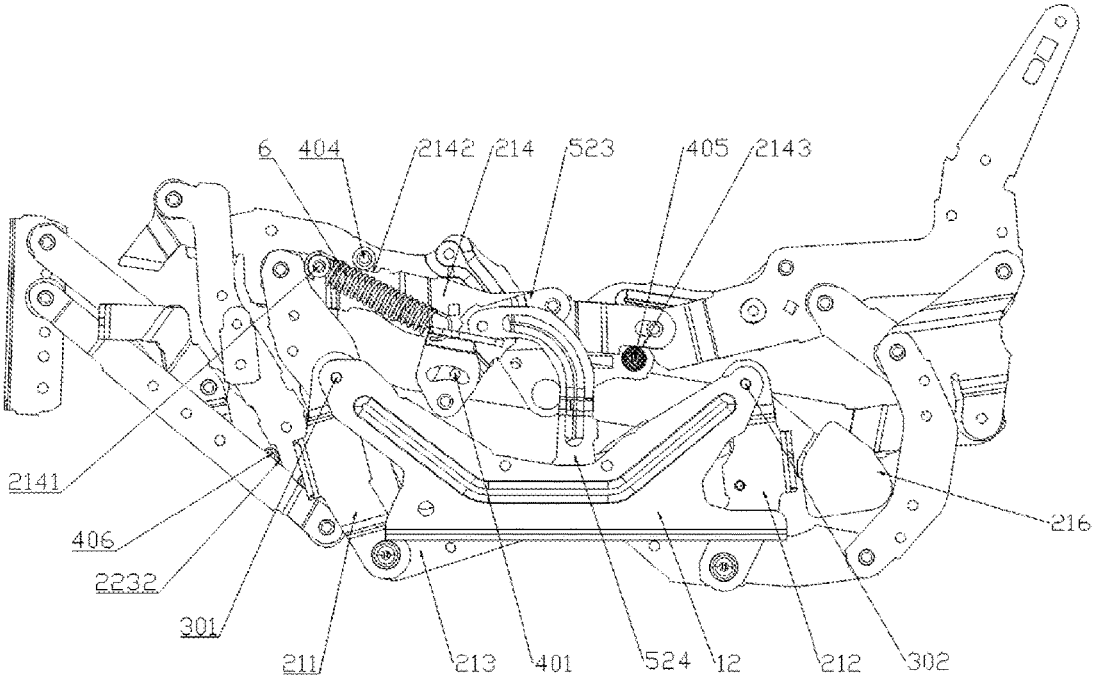
FIG. 3 is a front view of a stretching assembly in a sitting posture mode.
Figure 4:
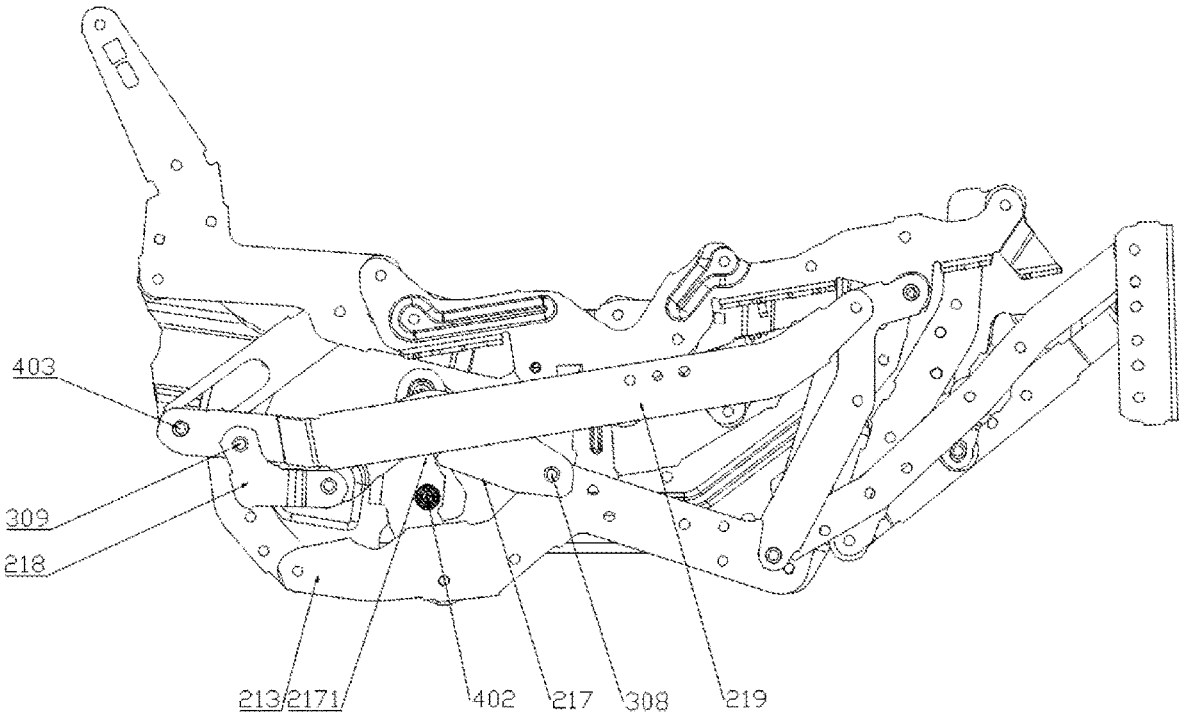
FIG. 4 is a back view of the stretching assembly in the sitting posture mode.
Figure 5:
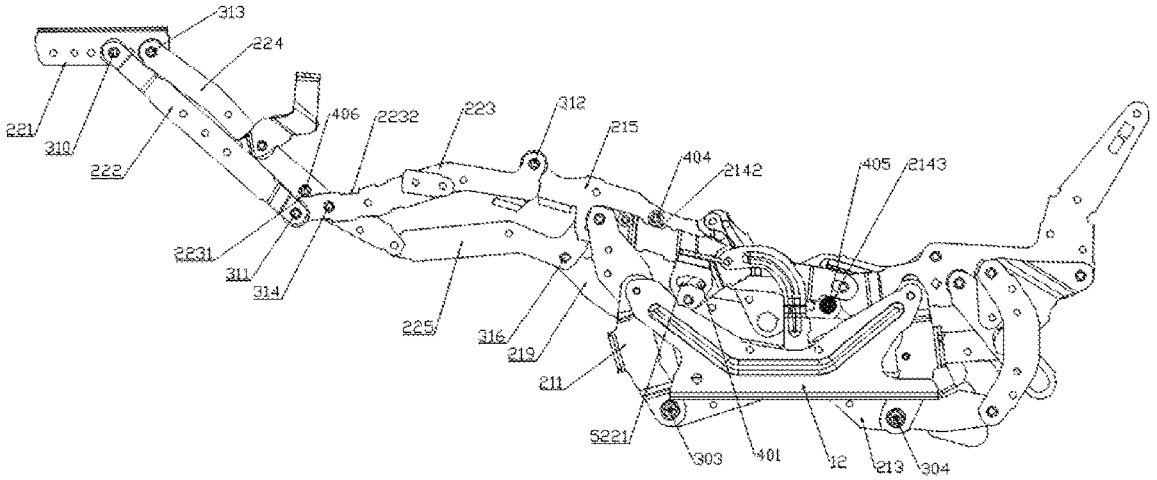
FIG. 5 is a front view of the stretching assembly in a TV-watching posture mode.
Figure 6:
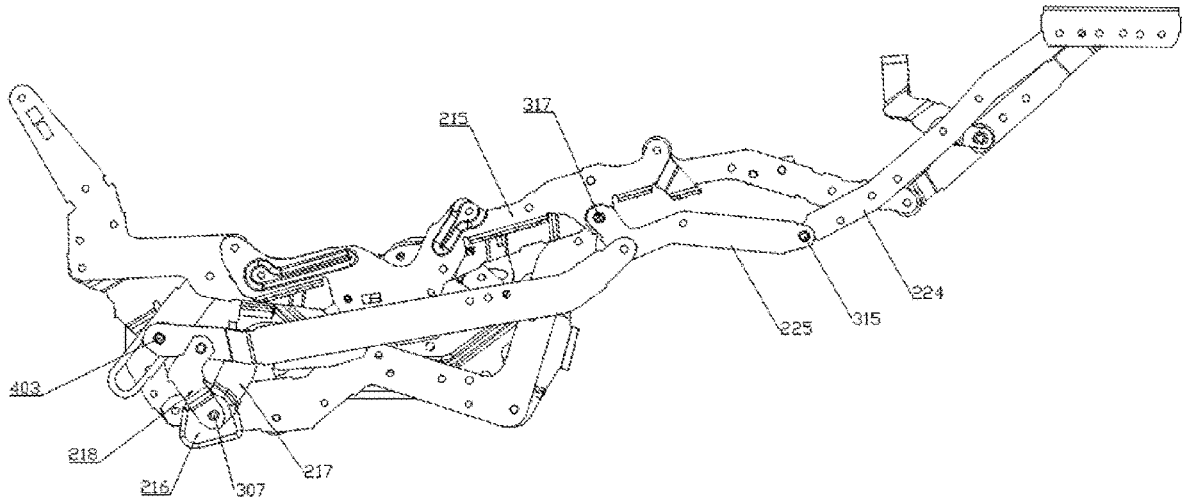
FIG. 6 is a back view of the stretching assembly in the TV-watching posture mode.
Figure 7:
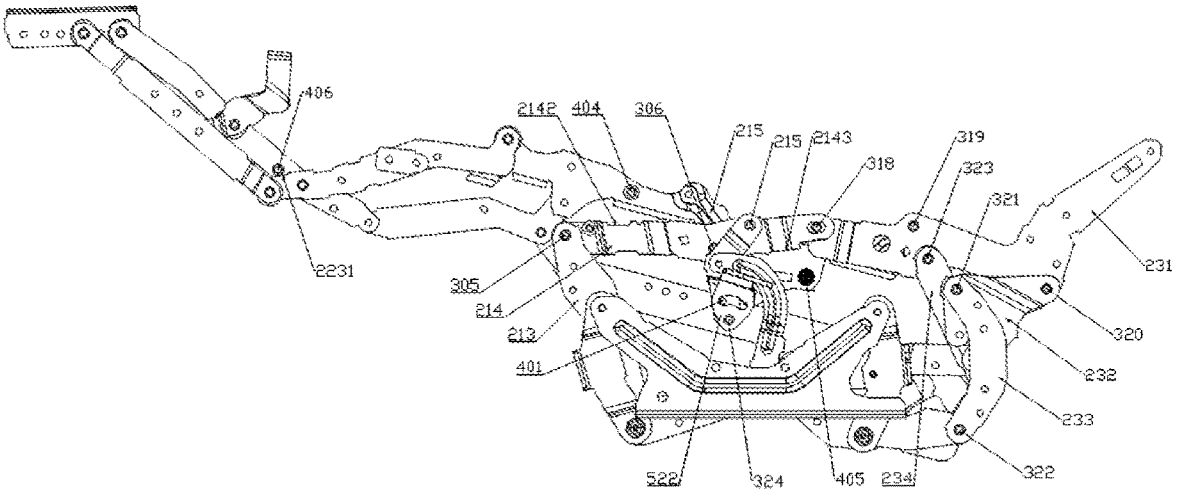
FIG. 7 is a front view of the stretching assembly in a lying posture mode.
Figure 8:
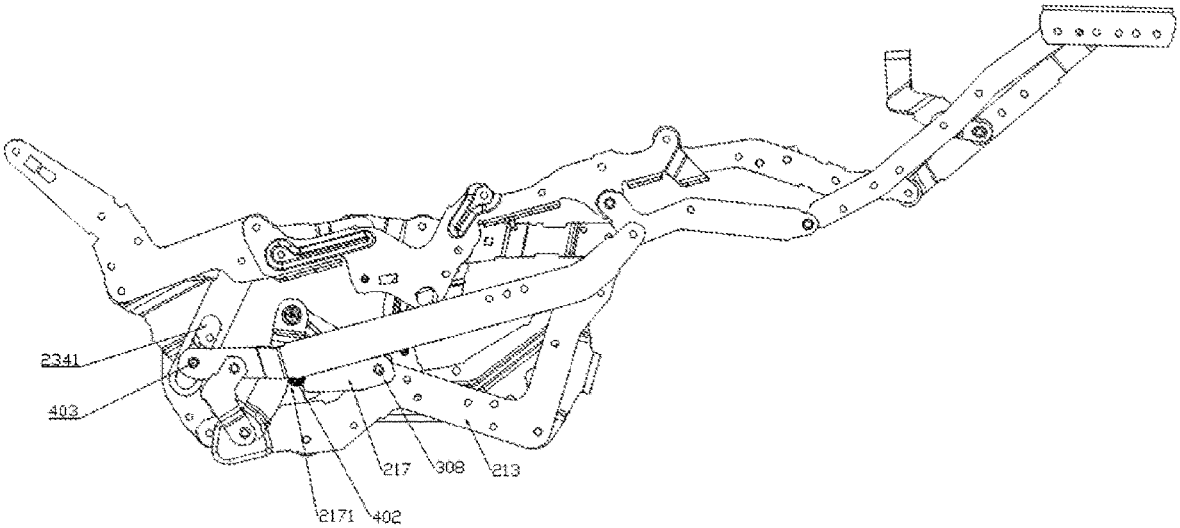
FIG. 8 is a back view of the stretching assembly in the lying posture mode.
Figure 9:
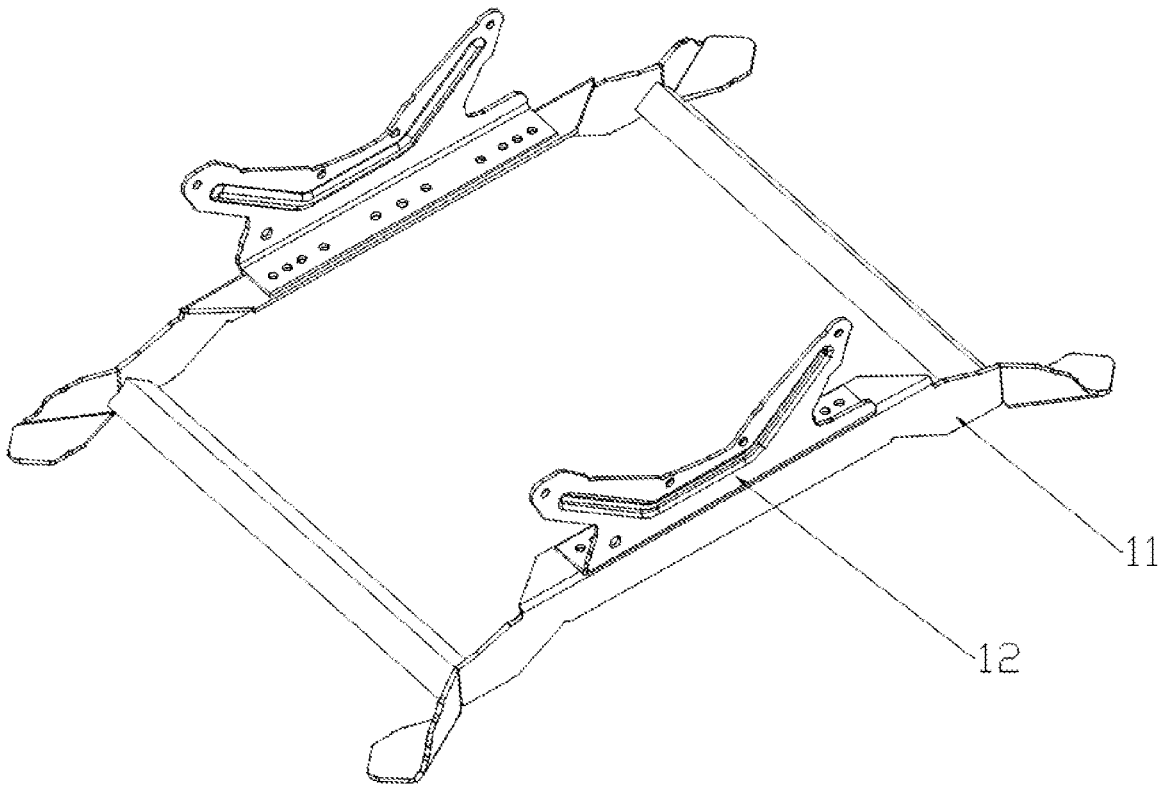
FIG. 9 is a structural schematic diagram of a base.

As shown in FIGS. 1 to 9, a stretching device for a leisure chair includes the base 1. The base includes the base frame 11. The mounting frames 12 are fixedly connected to the two sides of the base frame. The mounting frames are configured to pivotally connect the stretching assembly 2. The stretching assembly includes the seat plate mechanism 21 pivotally connected to the mounting frame. The front part of the seat plate mechanism is pivotally connected to the leg mechanism 22, and the rear part of the seat plate mechanism is pivotally connected to the backrest mechanism 23. The seat plate mechanism includes the first front rotating member 211 and the first rear rotating member 212. The first front rotating member is pivotally connected to the front part of the mounting frame through the first shaft 301, and the first rear rotating member is pivotally connected to the rear part of the mounting frame through the second shaft 302. The first front rotating member is pivotally connected to the first side link rod 213 through the third shaft 303, and the first rear rotating member is pivotally connected to the first side link rod through the fourth shaft 304. The first side link rod is pivotally connected to the second front rotating member 214 through the fifth shaft 305. The second front rotating member is pivotally connected to the side assembly plate 215 through the sixth shaft 306. The rear outer side of the first side link rod is fixedly connected to the spacer 216. The spacer is pivotally connected to the seat plate limit member 217 and the second rear rotating member 218 through the seventh shaft 307. The seat plate limit member is pivotally connected to the first side link rod through the eighth shaft 308. The first rear rotating member is fixedly connected to the second limit pin 402. The seat plate limit member is provided with the limit groove 2171 matched with the second limit pin. The rear rotating member is pivotally connected to the second side link rod 219 through the ninth shaft 309. The leg mechanism includes the footrest 221. The footrest is pivotally connected to the first leg link rod 222 through the tenth shaft 310. The first leg link rod is pivotally connected to the third leg link rod 223 through the eleventh shaft 311. The third leg link rod is pivotally connected to the side assembly plate through the twelfth shaft 312. The footrest is pivotally connected to the second leg link rod 224 through the thirteenth shaft 313. The second leg link rod is pivotally connected to the third leg link rod through the fourteenth shaft 314. The second leg link rod is pivotally connected to the fourth leg link rod 225 through the fifteenth shaft 315. The fourth leg link rod is pivotally connected to the second side link rod through the sixteenth shaft 316. The fourth leg link rod is pivotally connected to the side assembly plate through the seventeenth shaft 317. The backrest mechanism includes the backrest mounting plate 231. The backrest mounting plate is pivotally connected to the second front rotating member through the eighteenth shaft 318. The backrest mounting plate is pivotally connected to the side assembly plate through the nineteenth shaft 319. The backrest mounting plate is pivotally connected to the backrest rotating member 232 through the twentieth shaft 320. The backrest rotating member is pivotally connected to the backrest drive member 233 through the twenty-first shaft 321. The backrest drive member is pivotally connected to the first side link rod through the twenty-second shaft 322. The backrest rotating member is pivotally connected to the second side link rod through the third limit pin 403. The backrest mounting plate is pivotally connected to the backrest limit member 234 through the twenty-third shaft 323. The other end of the backrest limit member is provided with the slotted limit groove 2341 through which the third limit pin slides. The drive mechanism 5 is provided between the stretching assemblies on both sides. The drive mechanism includes the front drive rod 51 and the rear drive rod 52. The front drive rod and the rear drive rod drive the stretching assemblies to unfold or fold by the reciprocating motion device 53. The reciprocating motion device includes the motor 531 hinged to the front drive rod. The motor drives the sliding block 532 to slide on the sliding rail 533. The sliding block is fixedly connected to the rear drive rod. The two ends of the front drive rod are fixedly connected to the third leg link rod. The rear drive rod includes the rear drive rod body 521. The two ends of the rear drive rod body are fixedly connected to the bending member 522. The bending member is pivotally connected to the first drive member 523 through the twenty-fourth shaft 324. The first drive member is pivotally connected to the second drive member 524 through the twenty-fifth shaft 325. The first drive member is pivotally connected to the second front rotating member through the twenty-sixth shaft 326. The second drive member is pivotally connected to the first side link rod through the twenty-seventh shaft 327. The first drive member is fixedly connected to the first limit pin 401. The bending member is provided with the arcuate-slotted hole 5221 through which the first limit pin slides. The tension spring 6 is provided between the bending member and the second front rotating member. One end of the tension spring is connected to the bending member, and the other end of the tension spring is connected to the hanging pin 2141. The hanging pin is fixedly connected to the second rotating member.

The side assembly plate is provided with the fourth limit pin 404 and the fifth limit pin 405. The second front rotating member is provided with the first limit surface 2142 matched with the fourth limit pin and the second limit surface 2143 matched with the fifth limit pin. The second leg link rod is provided with the sixth limit pin 406. The third leg link rod is provided with the third limit surface 2231 and the fourth limit surface 2232 that are matched with the sixth limit pin.

The specific working process and principle of the present invention are as follows.

In a sitting posture mode, the sliding block is closest to the motor, the first limit pin is located in the central part of the arcuate-slotted hole, the second limit pin is separated from the limit groove, the third limit pin is located at the bottom of the rear side of the slotted limit groove, the fourth limit pin abuts the first limit surface, the fifth limit pin abuts the second limit surface, and the sixth limit pin abuts the fourth limit surface. At this time, the stretching assembly is in a folded state, and the stretching assembly can swing on the mounting frame.

When the sitting posture mode is switched to a TV-watching posture mode, the motor is activated, so that the sliding block and the motor move away from each other, the front drive rod unfolds the leg mechanism, the rear drive rod drives the seat plate mechanism to unfold through the first drive member and the second drive member, the first limit pin slides to the bottom of the rear side of the arcuate-slotted hole, the second limit pin slides into the limit groove to limit the swing of the stretching assembly, the third limit pin slides to the bottom of the front side of the slotted limit groove, the fourth limit pin keeps abutting the first limit surface, the fifth limit pin keeps abutting the second limit surface, and the sixth limit pin abuts the third limit surface. At this time, the tension spring is stretched.

When the TV-watching posture mode is switched to a lying posture mode, the motor remains activated, so that the first limit pin slides to the bottom of the front side of the arcuate-slotted hole, the second limit pin remains located in the limit groove to limit the swing of the stretching assembly, the third limit pin slides to the central part of the slotted limit groove, the fourth limit pin is separated from the first limit surface, the fifth limit pin is separated from the second limit surface, and the sixth limit pin remains abutting the third limit surface. At this time, the tension spring is pulled to the longest, and the backrest mechanism is unfolded.

What is claimed is:

1. A stretching device for a leisure chair, comprising
a base, wherein
stretching assemblies are symmetrically and pivotally connected to two sides of the base;
each of the stretching assemblies comprises a seat plate mechanism, a leg mechanism and a backrest mechanism, wherein a front part of the seat plate mechanism is pivotally connected to the leg mechanism, and a rear part of the seat plate mechanism is pivotally connected to the backrest mechanism;
a drive mechanism is provided between the stretching assemblies;
the drive mechanism comprises a front drive rod and a rear drive rod;
the front drive rod and the rear drive rod drive the stretching assemblies to unfold or fold by a reciprocating motion device;
two ends of the front drive rod are fixedly connected to a leg mechanism of each of the stretching assemblies;
two ends of the rear drive rod are pivotally connected to a first drive member;
a middle part of the first drive member is pivotally connected to a second drive member;
one end of the first drive member and one end of the second drive member are pivotally connected to the seat plate mechanism;
the first drive member is fixedly connected to a first limit pin;
the rear drive rod is provided with an arcuate-slotted hole, and
the first limit pin slides through the arcuate-slotted hole.

2. The stretching device according to claim 1, wherein
the base comprises a base frame;
mounting frames are fixedly connected to two sides of the base frame; and
each of the mounting frames are configured to pivotally connect to a respective one of the seat plate mechanisms.

3. The stretching device according to claim 2, wherein
the seat plate mechanism comprises a first front rotating member and a first rear rotating member;
a first end of the first front rotating member is pivotally connected to a front part of a respective one of the mounting frames, and a first end of the first rear rotating member is pivotally connected to a rear part of a respective one of the mounting frames;
a second end of the first front rotating member and a second end of the first rear rotating member are pivotally connected to a respective first side link rod;
a front part of the respective first side link rod is pivotally connected to a respective second front rotating member;
a middle inner side of the respective second front rotating member is pivotally connected to the first drive member, and a middle outer side of the respective second front rotating member is pivotally connected to a respective side assembly plate;
a middle part of the respective first side link rod is pivotally connected to the second drive member;
a rear part of the respective first side link rod is pivotally connected to a first end of a respective second rear rotating member;

a second end of the respective second rear rotating member is pivotally connected to a respective second side link rod;

a footrest connected to the leg mechanisms of the stretching assemblies;

the footrest is pivotally connected to a first end of a first leg link rod and a first end of a second leg link rod;

a second end of the first leg link rod is pivotally connected to a first end of a third leg link rod, and a second end of the second leg link rod is pivotally connected to a first end of a fourth leg link rod;

a second end of the third leg link rod and a second end of the fourth leg link rod are pivotally connected to a front part of the side assembly plate;

a rear part of the second leg link rod is pivotally connected to a front part of the second leg link rod;

a rear part of the fourth leg link rod is pivotally connected to a front end of the respective second side link rod;

each backrest mechanism of the stretching assemblies comprises a backrest mounting plate;

a front end of each of the backrest mounting plates is pivotally connected to the respective second front rotating member;

a middle front part of each of the backrest mounting plates is pivotally connected to the respective side assembly plate, and a middle part of each of the backrest mounting plates is pivotally connected to a respective backrest rotating member;

the backrest rotating member is pivotally connected to a first end of a backrest drive member;

a second end of the backrest drive member is pivotally connected to a rear end of the respective first side link rod; and one end of the backrest rotating member is pivotally connected to a rear end of the respective second side link rod.

4. The stretching device according to claim 3, wherein a tension spring is provided between the respective second front rotating member and the rear drive rod.

5. The stretching device according to claim 1, wherein the reciprocating motion device comprises a motor hinged to the front drive rod;

the motor drives a sliding block to slide on a sliding rail; and the sliding block is fixedly connected to the rear drive rod.

* * * * *